US008876553B2

(12) United States Patent
Lu

(10) Patent No.: US 8,876,553 B2
(45) Date of Patent: Nov. 4, 2014

(54) ALUMINUM TUBE COAXIAL CABLE CONNECTOR

(71) Applicant: Yueh-Chiung Lu, Tao-Yuan County (TW)

(72) Inventor: Yueh-Chiung Lu, Tao-Yuan County (TW)

( * ) Notice: Subject to any disclaimer, the term of this patent is extended or adjusted under 35 U.S.C. 154(b) by 209 days.

(21) Appl. No.: 13/672,209

(22) Filed: Nov. 8, 2012

(65) Prior Publication Data

US 2014/0127941 A1 May 8, 2014

(51) Int. Cl.
*H01R 9/05* (2006.01)

(52) U.S. Cl.
USPC ..... 439/584

(58) Field of Classification Search
USPC ..... 439/578, 583, 584
See application file for complete search history.

(56) References Cited

U.S. PATENT DOCUMENTS

| | | | | |
|---|---|---|---|---|
| 4,346,958 | A * | 8/1982 | Blanchard | 439/584 |
| 4,854,893 | A * | 8/1989 | Morris | 439/578 |
| 4,923,412 | A * | 5/1990 | Morris | 439/578 |
| 5,011,432 | A * | 4/1991 | Sucht et al. | 439/584 |
| 5,651,698 | A * | 7/1997 | Locati et al. | 439/578 |
| 6,102,738 | A * | 8/2000 | Macek et al. | 439/584 |
| 6,769,933 | B2 * | 8/2004 | Bence et al. | 439/578 |
| 6,808,415 | B1 * | 10/2004 | Montena | 439/584 |
| 6,884,113 | B1 * | 4/2005 | Montena | 439/578 |
| 6,884,115 | B2 * | 4/2005 | Malloy | 439/584 |
| 7,077,700 | B2 * | 7/2006 | Henningsen | 439/583 |
| 7,108,547 | B2 * | 9/2006 | Kisling et al. | 439/578 |
| 7,163,420 | B2 * | 1/2007 | Montena | 439/578 |
| 7,329,149 | B2 * | 2/2008 | Montena | 439/584 |
| 7,473,128 | B2 * | 1/2009 | Montena | 439/584 |
| 7,934,954 | B1 * | 5/2011 | Chawgo et al. | 439/578 |
| 7,950,961 | B2 * | 5/2011 | Chabalowski et al. | 439/584 |
| 7,972,176 | B2 * | 7/2011 | Burris et al. | 439/584 |
| 8,038,472 | B2 * | 10/2011 | Montena et al. | 439/578 |
| 8,287,309 | B1 * | 10/2012 | Thomas et al. | 439/578 |
| 8,333,612 | B2 * | 12/2012 | Natoli | 439/578 |
| 8,366,482 | B2 * | 2/2013 | Burris et al. | 439/584 |
| 8,388,375 | B2 * | 3/2013 | Chawgo et al. | 439/578 |
| 8,430,688 | B2 * | 4/2013 | Montena et al. | 439/578 |
| 8,435,073 | B2 * | 5/2013 | Wild et al. | 439/578 |
| 8,591,253 | B1 * | 11/2013 | Chawgo et al. | 439/578 |
| 8,591,254 | B1 * | 11/2013 | Chawgo et al. | 439/578 |
| 8,708,737 | B2 * | 4/2014 | Chawgo et al. | 439/578 |
| 2003/0135999 | A1 * | 7/2003 | Khemakhem et al. | 29/857 |
| 2004/0102088 | A1 * | 5/2004 | Bence et al. | 439/578 |
| 2004/0142596 | A1 * | 7/2004 | Henningsen | 439/584 |
| 2005/0085125 | A1 * | 4/2005 | Montena | 439/578 |
| 2005/0164553 | A1 * | 7/2005 | Montena | 439/578 |
| 2005/0170692 | A1 * | 8/2005 | Montena | 439/578 |
| 2006/0073726 | A1 * | 4/2006 | Montena | 439/320 |
| 2006/0194474 | A1 * | 8/2006 | Montena | 439/578 |
| 2008/0113554 | A1 * | 5/2008 | Montena | 439/585 |

(Continued)

*Primary Examiner* — Ross Gushi

(74) *Attorney, Agent, or Firm* — Muncy, Geissler, Olds & Lowe, P.C.

(57) ABSTRACT

An aluminum tube coaxial cable connector for CATV applications is disclosed to include a tubular screw member having locating notches at the rear end, a T-shaped insulative stopper and an insulative insert mounted in the tubular screw member to hold a conducting core, an inner tube having lugs protruded from a front rim thereof and engaged into the locating notches of the tubular screw member to prohibit relative rotation between the tubular screw member and the inner tube, a packing component set mounted around the inner tube, and a casing threaded onto the tubular screw member to compress the packing component set and to further lock an inserted aluminum tube coaxial cable to the aluminum tube coaxial cable connector.

8 Claims, 9 Drawing Sheets

(56) References Cited

U.S. PATENT DOCUMENTS

| | | | | |
|---|---|---|---|---|
| 2009/0269979 | A1* | 10/2009 | Montena | 439/578 |
| 2010/0022125 | A1* | 1/2010 | Burris et al. | 439/584 |
| 2010/0151728 | A1* | 6/2010 | Chabalowski et al. | 439/584 |
| 2012/0064765 | A1* | 3/2012 | Islam | 439/578 |
| 2012/0064766 | A1* | 3/2012 | Amidon et al. | 439/583 |
| 2012/0171895 | A1* | 7/2012 | Burris et al. | 439/584 |
| 2012/0252265 | A1* | 10/2012 | Wild et al. | 439/578 |
| 2012/0270438 | A1* | 10/2012 | Natoli | 439/578 |
| 2013/0183858 | A1* | 7/2013 | Chawgo et al. | 439/578 |
| 2013/0244484 | A1* | 9/2013 | Wild et al. | 439/578 |
| 2013/0323968 | A1* | 12/2013 | Chawgo et al. | 439/584 |
| 2014/0127941 | A1* | 5/2014 | Lu | 439/583 |
| 2014/0148044 | A1* | 5/2014 | Balcer et al. | 439/460 |

* cited by examiner

ALUMINUM TUBE COAXIAL CABLE CONNECTOR

BACKGROUND OF THE INVENTION

1. Field of the Invention

The present invention relates to cable connectors for community antenna television (CATV) applications and more particularly, to an aluminum tube coaxial cable connector, which facilitates quick installation, avoids relative rotation between component parts to affect installation, and ensures signal transmission reliability.

2. Description of the Related Art

With the progress and innovation of communication technology, many signal transmission materials have been continuously created to improve signal transmission stability and reliability. From early flat cables, to round cables and the modern aluminum tube coaxial cables and fiber optic cables for telephone, video, community antenna television (CATV), satellite television and internet applications, signal transmission capacity, speed and reliability have been significantly improved. FIG. 9 illustrates an aluminum tube coaxial cable connector A for connection to one end of an aluminum tube coaxial cable B for community antenna television (CATV) applications. As illustrated, this design of aluminum tube coaxial cable connector A comprises a casing A1 defining therein an axial hole A10 and an inner thread A11 in the axial hole A10, an inner tube A2 inserted into the axial hole A10 of the casing A1, a packing ring A3 mounted around the inner tube A2 inside the axial hole A10 of the casing A1, a collar A4 mounted inside the axial hole A10 of the casing A1 and forcible by the casing A1 to compress the packing ring A3, a tubular screw member A6 having an outer thread A61 threaded into the inner thread A11 of the casing A1, an insulative stopper A62 mounted in the front end of the tubular screw member A6, an insulative insert A5 mounted in the rear end of the tubular screw member A6, a conducting core A63 inserted through the insulative stopper A62 and having a rear end thereof terminating in a clamping tube A64 that is inserted into the center hole A51 of the insulative insert A5, and a spring plate A66 mounted in an outside annular groove A65 around the periphery of the tubular screw member A6. When inserting an aluminum tube coaxial cable B into the rear opening A12 of the casing A1, the inner tube A2 may be forced to vibrate, causing disengagement of the spring plate A66 from the inner thread A11 of the casing A1. If the spring plate A66 is disengaged from the inner thread A11 of the casing A1, the inner tube A2 may be forced out of the casing A1 accidentally. In actual application, this design of aluminum tube coaxial cable connector A has drawbacks as follows:

1. When inserting the aluminum tube coaxial cable B into the rear opening A12 of the casing A1 and the inside of the inner tube A2, the spring plate A66 may be unable to stop the inner tube A2 in place, and the inner tube A2, the packing ring A3 and the collar A4 may be forced out of the casing A1 accidentally, obstructing the installation.
2. When rotating the casing A1 relative to the tubular screw member A6 to fasten tight the connection between the aluminum tube coaxial cable connector A and the aluminum tube coaxial cable B, the inner tube A2 may be rotated relative to the aluminum tube coaxial cable B, damaging the electrical properties of the aluminum tube coaxial cable B.

Therefore, it is desirable to provide aluminum tube coaxial cable connector, which prevents falling of component parts or damaging the electrical properties of the inserted aluminum tube coaxial cable during installation.

SUMMARY OF THE INVENTION

The present invention has been accomplished under the circumstances in view. It is one object of the present invention to provide an aluminum tube coaxial cable connector for community antenna television (CATV) applications, which facilitates quick installation, avoids falling of component parts or relative rotation between component parts to affect installation, and ensures signal transmission reliability.

To achieve this and other objects of the present invention, an aluminum tube coaxial cable connector comprises a tubular screw member, a T-shaped insulative stopper and an insulative insert mounted in the tubular screw member to hold a conducting core, an inner tube attached to one end of the tubular screw member, a packing component set mounted around the inner tube, and a casing threaded onto the tubular screw member to compress the packing component set and to further lock an inserted aluminum tube coaxial cable to the inner tube and the tubular screw member. Further, the tubular screw member has locating notches located on the rear end thereof, and the inner tube has lugs protruded from a front rim thereof and respectively engaged into the locating notches of the tubular screw member to prohibit relative rotation between the tubular screw member and the inner tube during installation.

Further, a stopper ring and a cushion ring are arranged together and mounted in an outside annular groove around the periphery of the inner tube and stopped against an inside part of the casing to prohibit the inner tube, the packing component set and the tubular screw member from falling out of the casing during installation.

DETAILED DESCRIPTION OF THE PREFERRED EMBODIMENT

Figure 1:
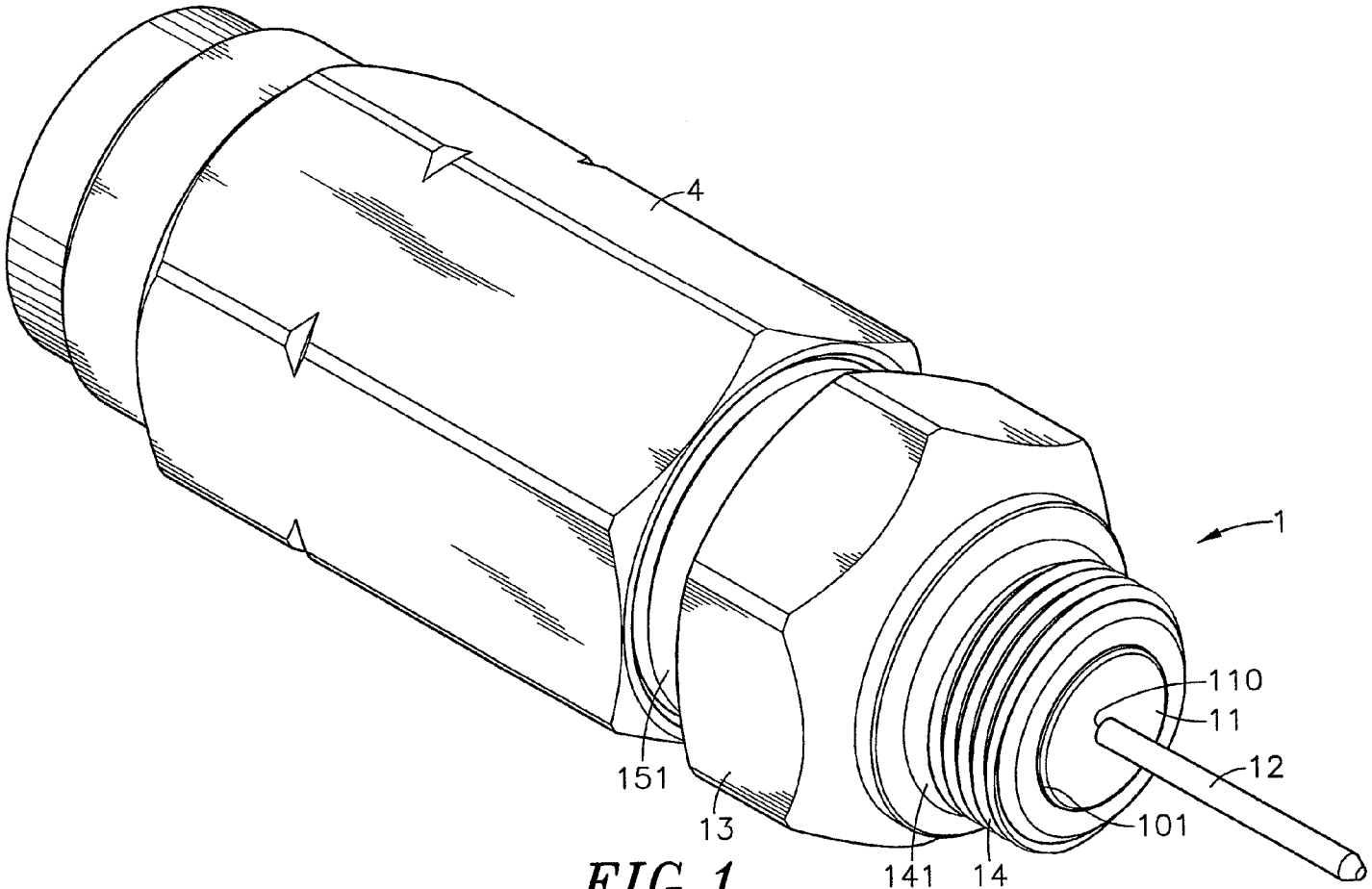
FIG. 1 is an elevational view of an aluminum tube coaxial cable connector in accordance with the present invention.
Figure 2:
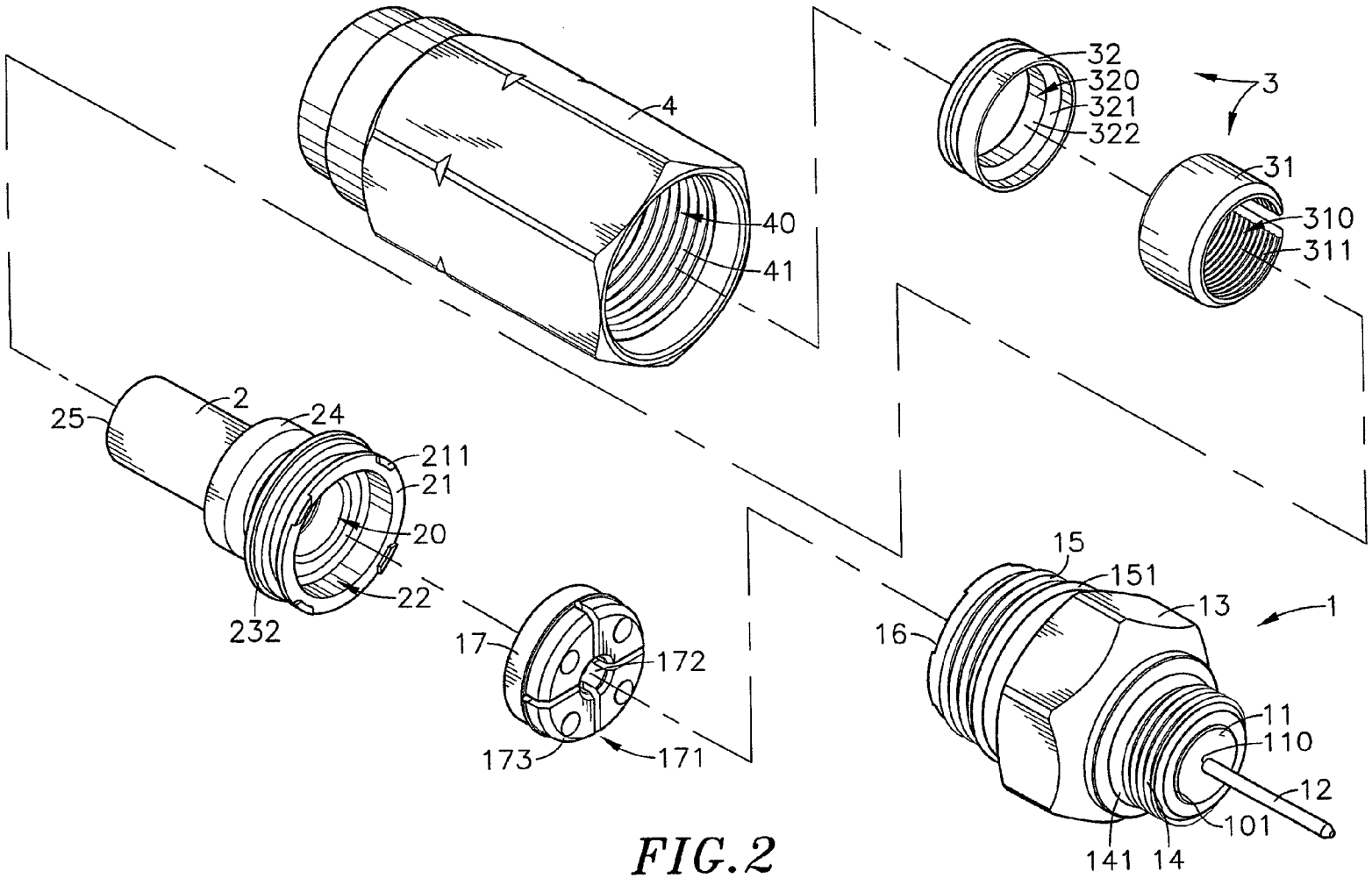
FIG. 2 is an exploded view of the aluminum tube coaxial cable connector in accordance with the present invention.
Figure 3:
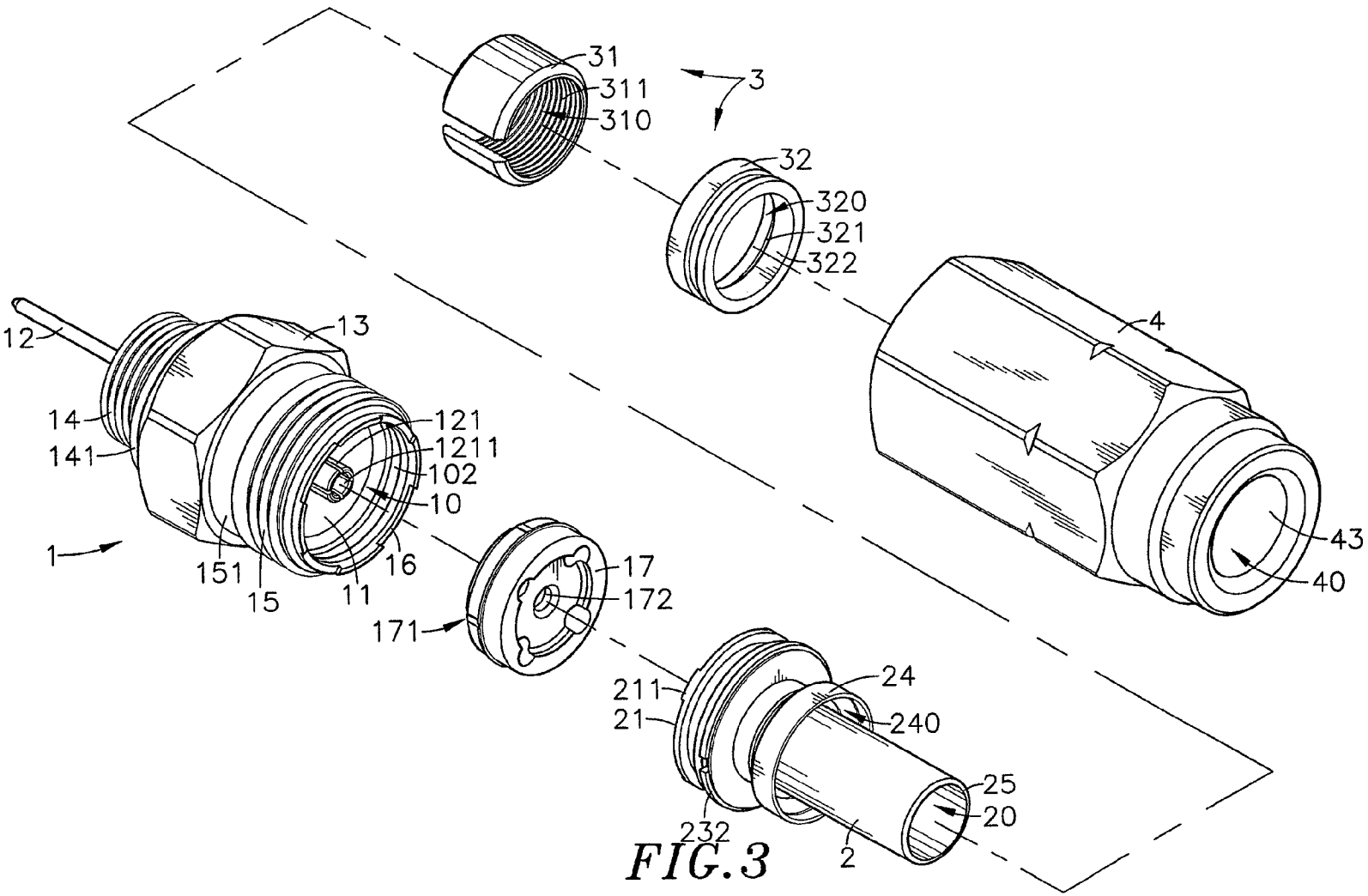
FIG. 3 is another exploded view of the aluminum tube coaxial cable connector in accordance with the present invention when viewed from another angle.
Figure 4:
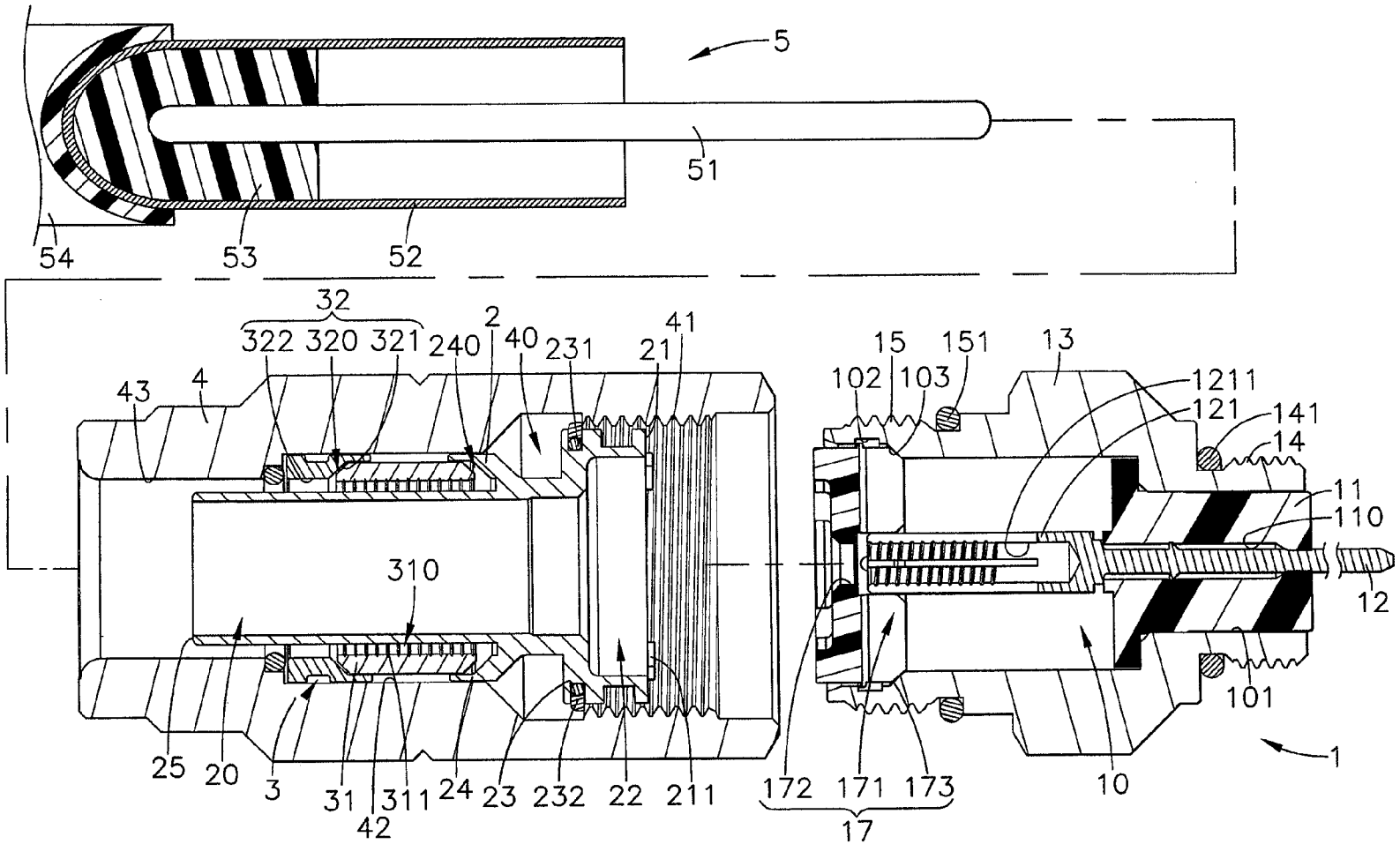
FIG. 4 is a sectional assembly view of the aluminum tube coaxial cable connector in accordance with the present invention.

Referring to FIGS. 1~4, an aluminum tube coaxial cable connector in accordance with the present invention is shown comprising a tubular screw member 1, a substantially T-shaped insulative stopper 11, a conducting core 12, an insulative insert 17, an inner tube 2, a packing component set 3, and a casing 4.

The tubular screw member 1 comprises a stepped axial hole 10 axially extending through opposing front and rear ends thereof and defining a small front hole 101 at the front end, a large rear hole 102 at the rear end and a tapered portion 103 in a front side of the large rear hole 102, a first outer thread 14 spirally extending around the periphery of the small front hole 101, a second outer thread 15 spirally extending around the periphery of the large rear hole 102, a polygonal flange 13 extending around the periphery on the middle between the first outer thread 14 and the second outer thread 15, and locating notches 16 located on the rear end adjacent to the second outer thread 15.

The T-shaped insulative stopper 11 is inserted into the stepped axial hole 10 of the tubular screw member 1 and press-fitted into the small front hole 101, defining therein an axially extending center hole 110.

The insulative insert 17 is press-fitted into the large rear hole 102 of the tubular screw member 1, comprising a center hole 172 axially centering through opposing front and rear sides thereof at the center, a plurality of clamping portions 171 disposed at the front side and spaced around the center hole 172. Each clamping portion 171 has a chamfered edge 173 stopped against the tapered portion 103 of the tubular screw member 1.

The conducting core 12 is inserted through the center hole 110 of the T-shaped insulative stopper 11 and partially suspending outside the front end of the tubular screw member 1, having a rear end thereof terminating in a clamping tube 121 that defines therein a clamping hole 1211. In this embodiment, the clamping tube 121 is a clamping tube having equiangularly spaced slits that divide the tube wall of the clamping tube into multiple pawls.

The inner tube 2 comprises an axial hole 20 extending through opposing front and rear ends thereof, a rim 21 located at the front end, a plurality of lugs 211 protruded from the rim 21, an accommodation open chamber 22 defined in the front end in communication with the axial hole 20, an outside annular groove 23 extending around the periphery thereof adjacent to the rim 21, a cushion ring 231 mounted in the outside annular groove 23, a stopper ring 232, a cup shell 24 extending around the periphery, and an annular mating space 240 defined within the cup shell 24 around the periphery thereof. In this embodiment, the stopper ring 232 is a C-shaped retaining ring.

The packing component set 3 comprises a packing ring 31 and a collar 32. The packing ring 31 is a C-shaped clamping ring having an anti-slip design 311 on the inner perimeter thereof and defining therein a clamping space 310. The collar 32 defines a front tapered hole 321 and a rear thrust hole 322 in the inside space 320 thereof. The packing ring 31 is inserted with its one end into the front tapered hole 321 of the collar 32 toward the rear thrust hole 322.

The casing 4 comprises an inside receiving space 40 axially extending through opposing front and rear ends thereof, an inner thread 41 spirally extending the inside wall thereof on the front side of the inside receiving space 40, a middle packing section 42 on the middle of the inside receiving space 40, and a rear insertion section 43 on the rear side of the inside receiving space 40.

When assembling the aluminum tube coaxial cable connector, insert the T-shaped insulative stopper 11 into the stepped axial hole 10 and small front hole 101 of the tubular screw member 1, and then insert the conducting core 12 through the center hole 110 of the T-shaped insulative stopper 11, and then press-fit the insulative insert 17 into the large rear hole 102 of the tubular screw member 1, and then attach the lugs 211 of the inner tube 2 to the respective locating notches 16 of the tubular screw member 1, and then sleeve the packing ring 31 of the packing component set 3 onto the inner tube 2 and force the packing ring 31 into the annular mating space 240 in the cup shell 24, and then sleeve the collar 32 of the packing component set 3 onto the inner tube 2 to have the packing ring 31 be partially received in the inside space 320 of the collar 32, and then insert the inner tube 2 with the packing component set 3 and the tubular screw member 1 into the inside receiving space 40 of the casing 4 and then thread the second outer thread 15 of the tubular screw member 1 into the inner thread 41 of the casing 4 to force the packing component set 3 against the middle packing section 42 of the casing 4 and to suspend the rear end of the inner tube 2 in the rear insertion section 43 of the casing 4.

After assembled the aluminum tube coaxial cable connector, the clamping tube 121 of the conducting core 12 is attached to the center hole 172 of the insulative insert 17 to keep the clamping hole 1211 in communication with the center hole 172 of the insulative insert 17. Further, a first gasket ring 141 and a second gasket ring 151 can be respectively attached to the periphery of the tubular screw member 1 and respectively stopped at the opposing front and rear sides of the polygonal flange 13.

Further, by means of attaching the lugs 211 of the inner tube 2 to the respective locating notches 16 of the tubular screw member 1, the tubular screw member 1 and the inner tube 2 are prohibited from rotation relative to each other. Thus, when attaching the aluminum tube coaxial cable connector to an aluminum tube coaxial cable 5 and fastening tight the connection between the aluminum tube coaxial cable connector and the aluminum tube coaxial cable 5 through a rotary motion, the inner tube 2 is prohibited from rotation relative to the aluminum tube coaxial cable 5. Further, in an alternate form of the present invention, the lugs 211 can be located at the tubular screw member 1, and the locating notches 16 can be located at the inner tube 2 for engagement with the lugs 211. Further, subject to the anti-slip design 311 of the packing ring 31, the packing ring 31 can be positively compressed against the periphery of the inner tube 2. Further, the anti-slip design 311 can be an array of V-shaped, U-shaped, S-shaped or serrated teeth or grooves, or an array of trapezoidal, rounded or conical protrusions.

Figure 5:
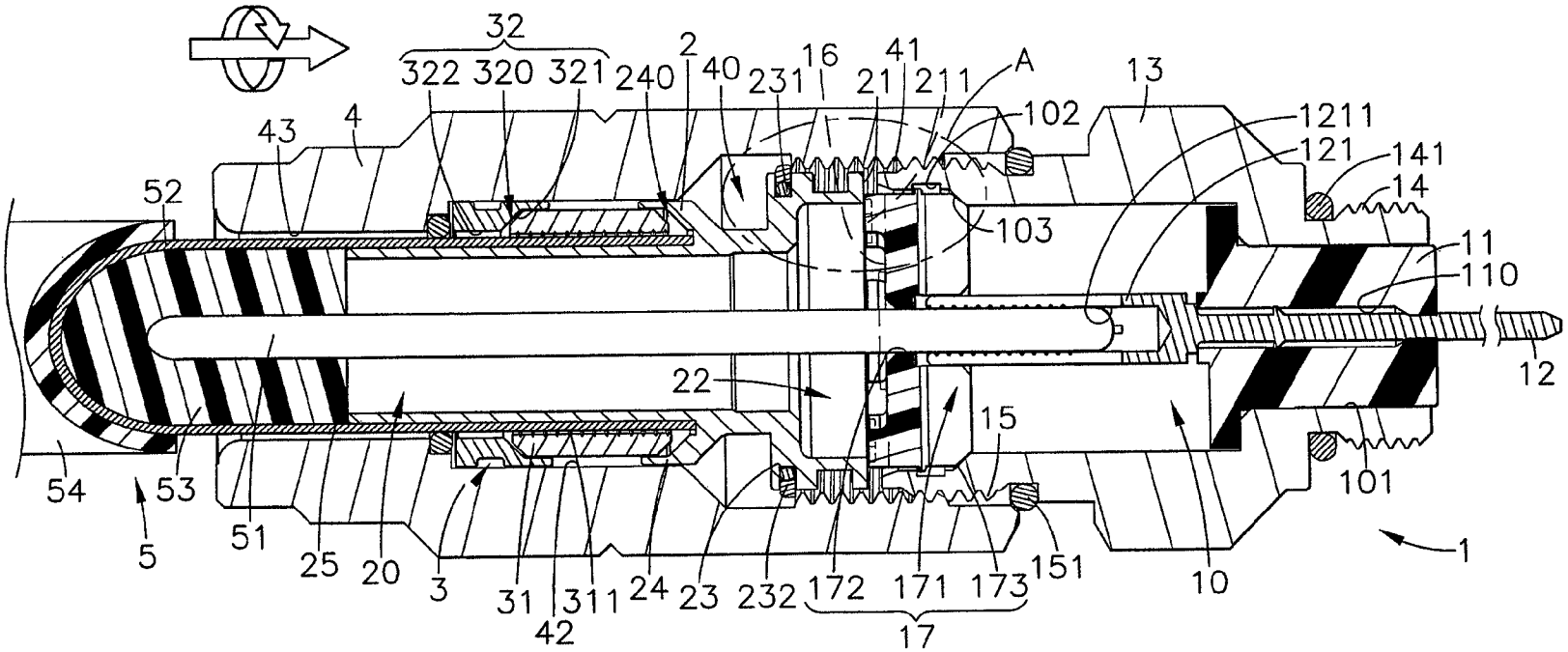
FIG. 5 is a schematic installed view of the present invention, illustrating the aluminum tube coaxial cable connector attached to an aluminum tube coaxial cable.
Figure 6:
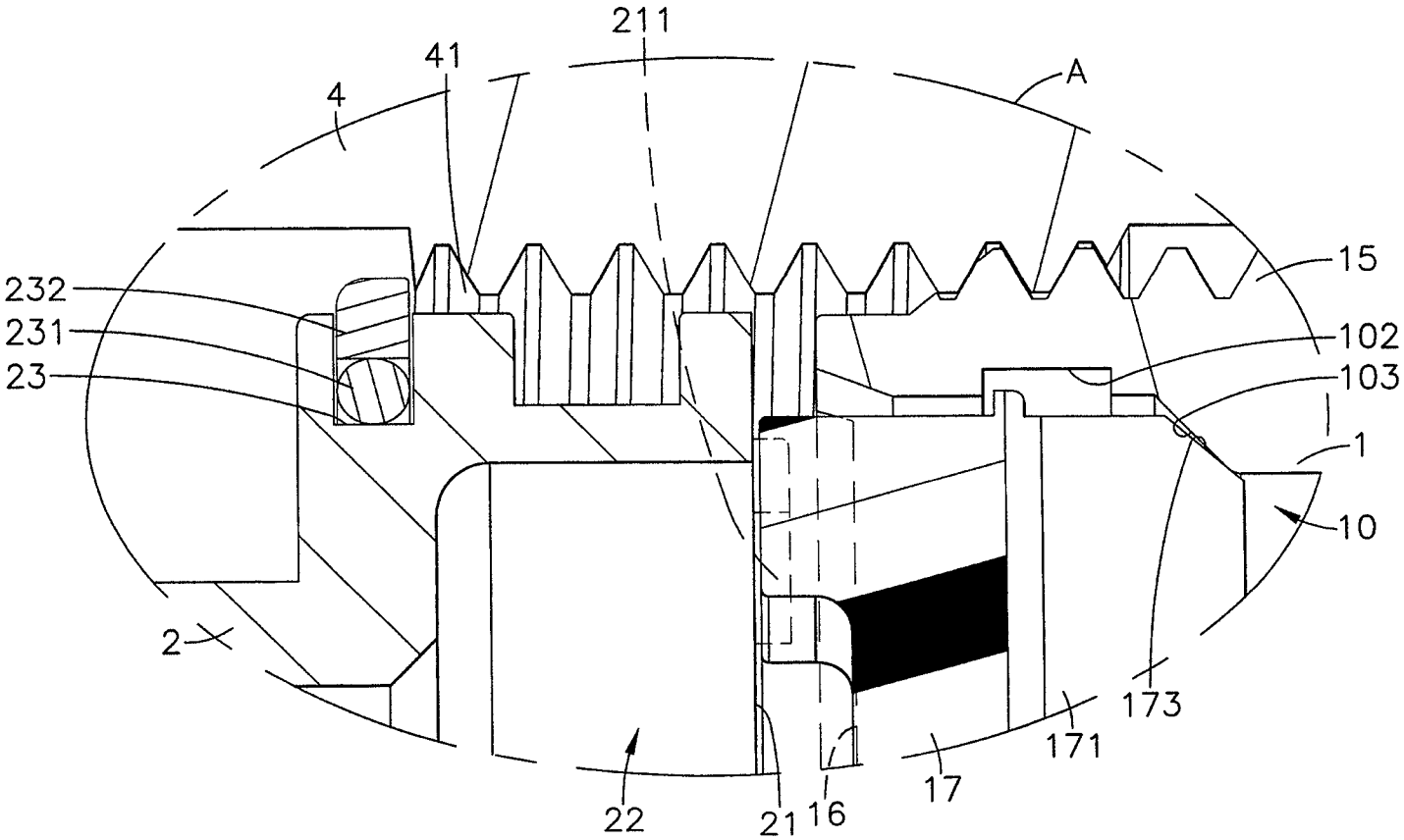
FIG. 6 is an enlarged view of Part A of FIG. 5.
Figure 7:
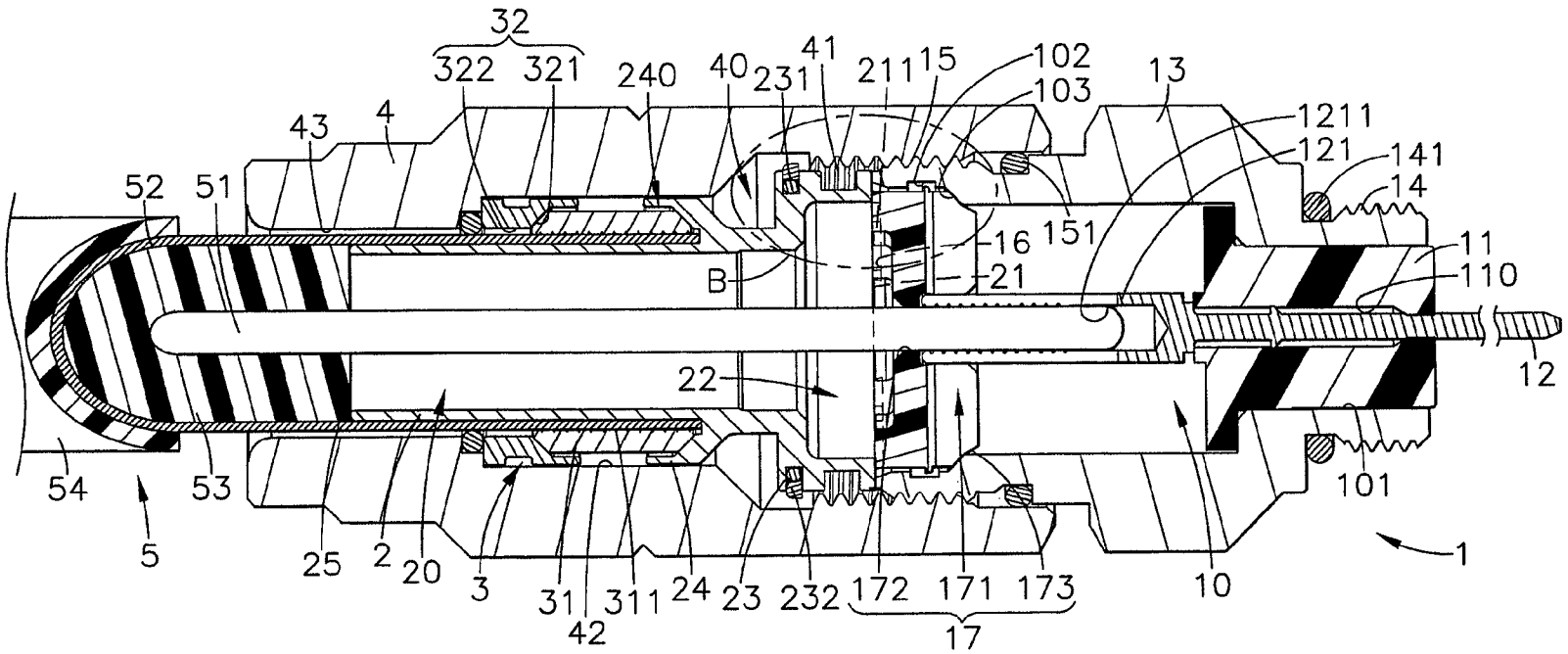
FIG. 7 corresponds to FIG. 5, illustrating the aluminum tube coaxial cable connector attached locked to the aluminum tube coaxial cable.
Figure 8:
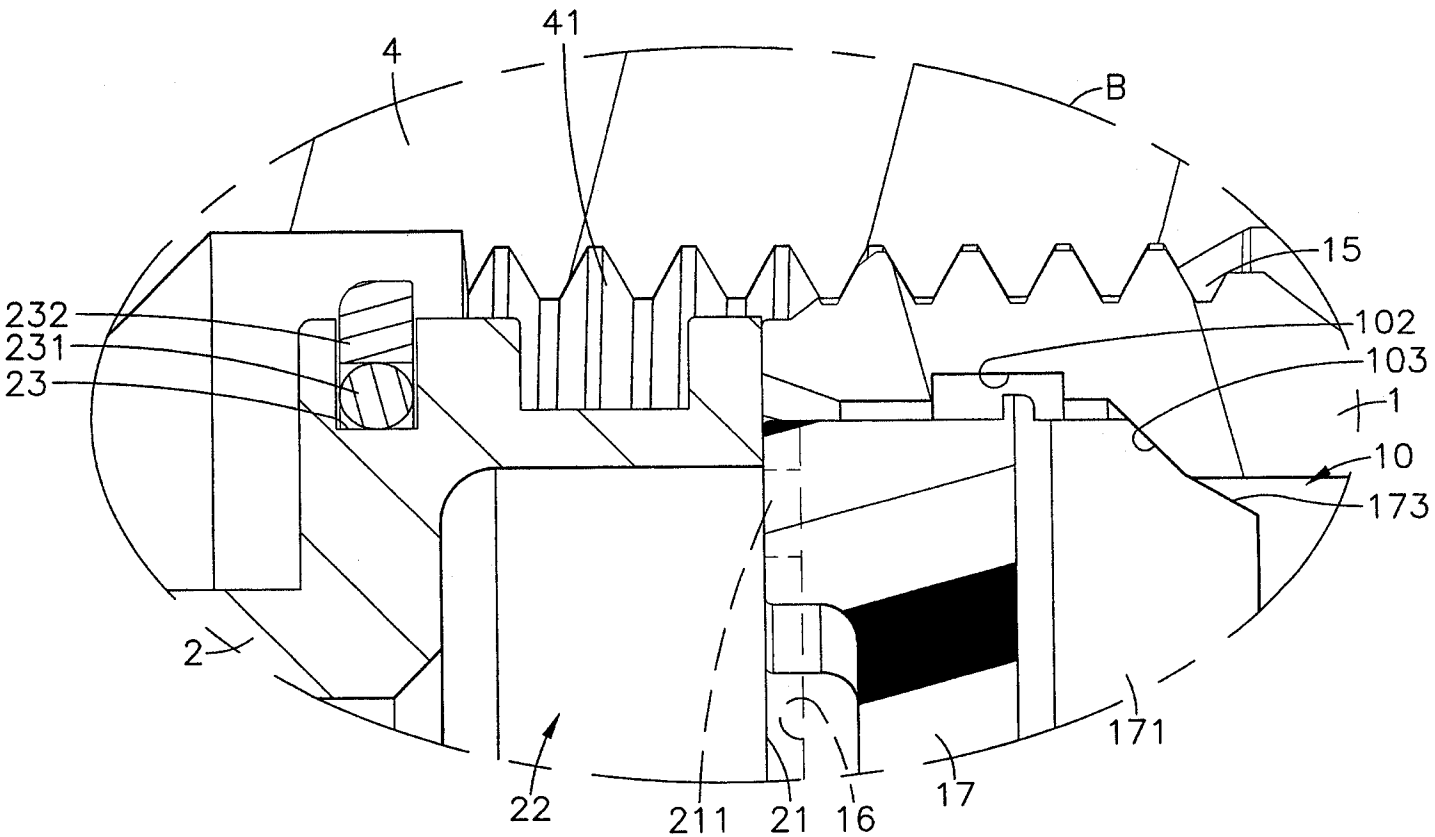
FIG. 8 is an enlarged view of Part B of FIG. 7.
Figure 9:
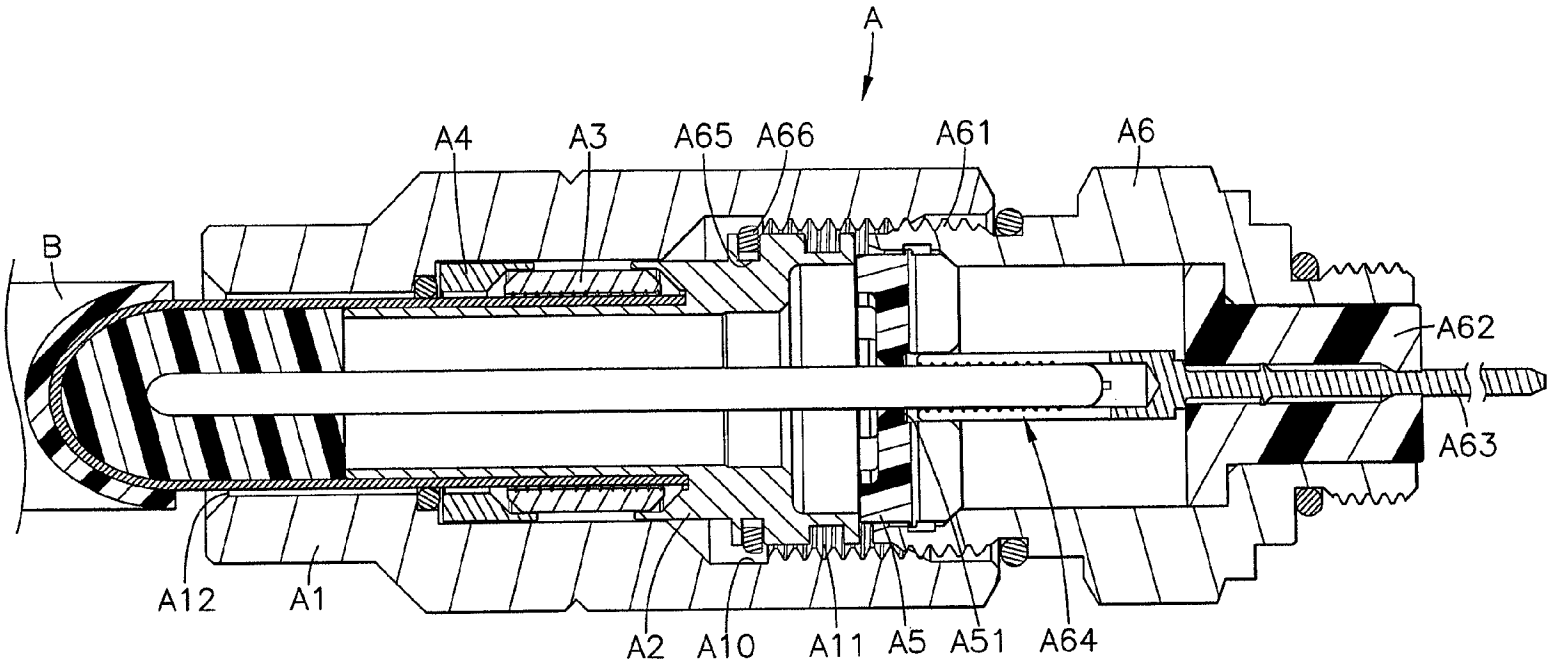
PRIOR ART FIG. 9
FIG. 9 is a sectional view of an aluminum tube coaxial cable connector according to the prior art.

Referring to FIGS. 5-8 and FIGS. 2-4 again, the aluminum tube coaxial cable 5 comprises a center conductor 51, an inner insulating layer 53 surrounding the center conductor 51, an aluminum tube 52 surrounding the inner insulating layer 53, and an outer insulating sheath 54 surrounding the aluminum tube 52. After removal of a predetermined part of the outer insulating sheath 54 of the aluminum tube coaxial cable 5, the aluminum tube coaxial cable 5 is inserted into the rear insertion section 43 of the casing 4 to force the center conductor 51 into the center hole 172 of the insulative insert 17 and the clamping hole 1211 of the clamping tube 121 of the conducting core 12. At this time, the chamfered edges 173 of the clamping portions 172 of the insulative insert 17 are forced by the tapered portion 103 of the tubular screw member 1 to compress the clamping tube 121 of the conducting core 12 against the periphery of the inserted center conductor 51, the inner insulating layer 53 of the aluminum tube coaxial cable 5 is abutted against the rear end edge 25 of the inner tube 2, and the aluminum tube 52 of the aluminum tube coaxial cable 5 is sleeved onto the inner tube 2 and inserted into the inside space 320 of the collar 32 of the packing component set 3 and the clamping space 310 in the packing ring 31 and the annular mating space 240 in the cup shell 24.

Further, during insertion of the aluminum tube 52 of the aluminum tube coaxial cable 5 into the inside space 320 of the collar 32 of the packing component set 3 and the clamping space 310 in the packing ring 31 and the annular mating space 240 in the cup shell 24, the stopper ring 232 that is supported on the cushion ring 231 in the outside annular groove 23 is stopped against the inner thread 41 of the casing 4, prohibiting the inner tube 2, the packing component set 3 and the tubular screw member 1 from falling out of the inside receiving space 40 of the casing 4 to affect installation.

Thereafter, the casing 4 is rotated to thread the inner thread 41 onto the second outer thread 15 of the tubular screw member 1, forcing the rear insertion section 43 of the casing 4 to push the collar 32 of the packing component set 3 against the packing ring 31. At this time, the front tapered hole 321 of the collar 32 of the packing component set 3 is forced to compress the packing ring 31 against the aluminum tube 52 of the aluminum tube coaxial cable 5 and the periphery of the inner tube 2, thereby locking the aluminum tube 52 of the aluminum tube coaxial cable 5 to the inner tube 2. At the same time, the chamfered edges 173 of the clamping portions 172 of the insulative insert 17 are stopped against the tapered portion 103 of the tubular screw member 1 to compress the clamping tube 121 of the conducting core 12 against the periphery of the inserted center conductor 51, enhancing connection tightness between the conducting core 12 and the inserted center conductor 51. When rotating the casing 4 relative to the aluminum tube coaxial cable 5 and the tubular screw member 1, the lugs 211 of the inner tube 2 are kept engaged with the respective locating notches 16 of the tubular screw member 1, prohibiting rotation of the inner tube 2 relative to the tubular screw member 1. Thus, the aluminum tube coaxial cable connector and the aluminum tube coaxial cable 5 can be quickly and positively connected together to ensure signal transmission reliability.

As stated above, the invention provides an aluminum tube coaxial cable connector for CATV. The aluminum tube coaxial cable connector comprises a tubular screw member 1, which comprises a stepped axial hole 10 defining a small front hole 101 at the front end, a large rear hole 102 at the rear end and a tapered portion 103 in a front side of the large rear hole 102, a polygonal flange 13 extending around the periphery of the middle, a first outer thread 14 and a second outer thread 15 spirally extending around the periphery at two opposite sides relative to the polygonal flange 13 and locating notches 16 located on the rear end thereof, a T-shaped insulative stopper 11 press-fitted into the small front hole 101, an insulative insert 17, which is press-fitted into the large rear hole 102 of the tubular screw member 1, comprising a center hole 172 and a plurality of clamping portions 171 disposed at the front side and spaced around the center hole 172 and providing a respective chamfered edge 173 that is stopped against the tapered portion 103 of the tubular screw member 1, a conducting core 12 inserted through the T-shaped insulative stopper 11 and having a rear end thereof terminating in a clamping tube 121 that is positioned in the center hole 172 and held down by the clamping portions 171, an inner tube 2 attached to the insulative insert 17 and stopped against the rear end of the tubular screw member 1 and having lugs 211 protruded from a front rim 21 thereof and engaged into the locating notches 16 of the tubular screw member 1 to prohibit relative rotation between the tubular screw member 1 and the inner tube 2, a packing component set 3 mounted around the inner tube 2, and a casing 4 threaded with an inner thread 41 thereof onto the second outer thread 15 of the tubular screw member 1 to compress the packing component set 3 against the inserted aluminum tube coaxial cable 5 and to further lock the aluminum tube coaxial cable connector to the aluminum tube coaxial cable 5 for signal transmission, a cushion ring 231 mounted in an outside annular groove 23 of the inner tube 2, and a stopper ring 232 supported on the cushion ring 231 and stopped against the inner thread 41 of the casing 4 to prohibit the inner tube 2, the packing component set 3 and the tubular screw member 1 from falling out of the casing 4 during installation.

In conclusion, the invention provides an aluminum tube coaxial cable connector, which has the advantages and features as follows:

1. The tubular screw member 1 has locating notches 16 located on the rear end thereof, and the inner tube 2 has lugs 211 protruded from the front rim 21 thereof and respectively engaged into the locating notches 16 of the tubular screw member 1 to prohibit relative rotation between the tubular screw member 1 and the inner tube 2 during installation.
2. The stopper ring 232 and the cushion ring 231 are arranged together and mounted in the outside annular groove 23 of the inner tube 2 and stopped against the inner thread 41 of the casing 4 to prohibit the inner tube 2, the packing component set 3 and the tubular screw member 1 from falling out of the casing 4 during installation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An aluminum tube coaxial cable connector, comprising:

a tubular screw member comprising an axial hole axially extending through opposing front and rear ends thereof, a tapered portion defined in the axial hole, a first outer thread disposed near the front end, a second outer thread disposed near the rear end, and at least one locating notch located on the rear end adjacent to said second outer thread;

a T-shaped insulative stopper positioned in the axial hole in the front end of said tubular screw member;

an insulative insert positioned in the axial hole in the rear end of said tubular screw member, said insulative insert comprising a center hole axially centering through opposing front and rear sides thereof;

a conducting core inserted through said T-shaped insulative stopper and partially suspending outside the front end of said tubular screw member, said conducting core having a rear end thereof terminating in a clamping tube, said clamping tube defining therein a clamping hole;

an inner tube comprising an axial hole extending through opposing front and rear ends thereof, a rim located at the front end and stopped against a part of said insulation insert, at least one lug protruded from said rim and engaged into said at least one locating notch of said tubular screw member, an accommodation open chamber defined in the front end in communication with the axial hole, a cup shell extending around the periphery thereof, and an annular mating space defined within said cup shell around the periphery of said inner tube;

a packing component set comprising a packing ring inserted into said annular mating space in said cup shell of said inner tube, and a collar attached to said packing ring, said collar defining therein an inside space adapted for receiving said packing ring; and a casing surrounding said inner tube and said packing component set, said casing comprising an inside receiving space axially extending through opposing front and rear ends thereof for accommodating said inner tube, an inner thread spirally extending an inside wall thereof on a front side of said inside receiving space and threaded onto said second inner thread of said tubular screw member.

2. The aluminum tube coaxial cable connector as claimed in claim 1, wherein the axial hole of said tubular screw member is a stepped hole; said T-shaped insulative stopper is positioned in a relatively smaller diameter portion at a front side of the axial hole of said tubular screw member, defining an axially extending center hole for the passing of said conducting core.

3. The aluminum tube coaxial cable connector as claimed in claim 1, wherein said clamping tube is a split tube having equiangularly spaced slits formed in a tube wall thereof and dividing the tube wall into a plurality of pawls.

4. The aluminum tube coaxial cable connector as claimed in claim 1, wherein said insulative insert comprises a plurality of clamping portions spaced around the center hole thereof, each said clamping portion having a chamfered edge stopped against the tapered portion of said tubular screw member.

5. The aluminum tube coaxial cable connector as claimed in claim 1, wherein said inner tube comprises an outside annular groove extending around the periphery thereof adjacent to said rim, a cushion ring mounted in said outside annular groove, a stopper ring made in the form of a C-shaped retaining ring and supported on said cushion ring and stopped against a part of said casing in the inside receiving space of said casing.

6. The aluminum tube coaxial cable connector as claimed in claim 1, wherein said packing ring is a C-shaped clamping ring having an anti-slip design on an inner perimeter thereof.

7. The aluminum tube coaxial cable connector as claimed in claim 1, wherein said anti-slip design is selected from the group of V-shaped teeth array, U-shaped teeth array, S-shaped teeth array, serrated teeth array, V-shaped groove array, U-shaped groove array, S-shaped groove array, serrated groove array, trapezoidal protrusion array, rounded protrusion array, and conical protrusion array.

8. The aluminum tube coaxial cable connector as claimed in claim 1, wherein the casing comprises a middle packing section at the rear side of the said inner thread and a rear insertion section with a reduced diameter on the rear side of the inside receiving space.

* * * * *